US009455534B2

(12) United States Patent
Resendez et al.

(10) Patent No.: US 9,455,534 B2
(45) Date of Patent: Sep. 27, 2016

(54) INTEGRATED SIGNAL PAIR ELEMENT AND CONNECTOR USING SAME

(71) Applicant: Molex, LLC, Lisle, IL (US)

(72) Inventors: Javier Resendez, Streamwood, IL (US); Michael D. Rost, Lisle, IL (US); Eric A. Deichmann, Naperville, IL (US); Kenneth F. Janota, Conway, AR (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/776,344

(22) PCT Filed: Mar. 13, 2014

(86) PCT No.: PCT/US2014/025762
§ 371 (c)(1),
(2) Date: Sep. 14, 2015

(87) PCT Pub. No.: WO2014/160073
PCT Pub. Date: Oct. 2, 2014

(65) Prior Publication Data

US 2016/0028189 A1 Jan. 28, 2016

Related U.S. Application Data

(60) Provisional application No. 61/779,757, filed on Mar. 13, 2013.

(51) Int. Cl.

| | |
|---|---|
| ***H01R 13/648*** | (2006.01) |
| ***H01R 13/6581*** | (2011.01) |
| ***H01R 9/03*** | (2006.01) |
| ***H01R 13/658*** | (2011.01) |

(52) U.S. Cl.
CPC ..... *H01R 13/6581* (2013.01); *H01R 9/034* (2013.01); *H01R 13/65807* (2013.01)

(58) Field of Classification Search
CPC ..... H01R 13/6581; H01R 9/034; H01R 13/65807
USPC ..... 439/607.01, 607.05, 607.08
See application file for complete search history.

(56) References Cited

U.S. PATENT DOCUMENTS

| | | | | |
|---|---|---|---|---|
| 4,932,888 | A * | 6/1990 | Senor | H01R 13/65802 439/108 |
| 7,967,645 | B2 | 6/2011 | Marti et al. | |
| 8,118,600 | B2 | 2/2012 | Miki et al. | |
| 2005/0020135 | A1 | 1/2005 | Whiteman, Jr. et al. | |
| 2006/0276081 | A1 | 12/2006 | Cohen et al. | |
| 2008/0305689 | A1 | 12/2008 | Zhang et al. | |

* cited by examiner

*Primary Examiner* — Javaid Nasri
(74) *Attorney, Agent, or Firm* — Stephen L. Sheldon

(57) ABSTRACT

Integrated signal pair elements are disclosed that can be inserted into and removed from a backplane connector housing as a single piece. Each element includes an insulative frame that supports a pair of conductive terminals in a spaced-apart arrangement. The frame is attached to a ground shield that provides a ground plane that extends around three sides of the signal pair. Cable wires are terminated to tail portions of the signal pair and an insulative material is molded over the cable wire termination area to form an integrated signal pair element. The individual signal pair elements may also be commoned together in a linear array of signal pair elements by a commoning member that contacts the ground shields of the array of signal pair elements.

24 Claims, 17 Drawing Sheets

INTEGRATED SIGNAL PAIR ELEMENT AND CONNECTOR USING SAME

CROSS REFERENCE TO RELATED APPLICATIONS

The Present Disclosure claims priority to prior-filed U.S. Provisional Patent Application No. 61/779,757, entitled "Integrated Signal Pair Element And Connector Using Same," filed on 13 Mar. 2013 with the United States Patent And Trademark Office. The content of the aforementioned Patent Application is fully incorporated in its entirety herein.

BACKGROUND OF THE PRESENT DISCLOSURE

The Present Disclosure relates, generally, to backplane connectors, and, more particularly, to improved cable assembly connectors utilized in backplane applications.

Existing backplane connectors which utilize waferized structures can be prohibitively expensive to tool-up. Wafers are designed to support a set number of signal pairs and ground elements associated with the signal pairs. These elements are supported by a frame typically formed from a thermoplastic and molded over portions of the signal and ground elements. As such, each particular wafer requires its own mold and stamping and forming operation. Thus, the costs required to tool up waferized connectors are large.

A customer usually needs to have very significant volume or a willingness to pay non-recoverable tooling fees for tooling up a new wafer. Each wafer count must be tooled as a new part including stamping dies, mold cavities, plating tooling, assembly tooling, and the tooling for assembling the connectors into finished cable assemblies as a mold for a four-pair wafer cannot be used to make either a three- or five-pair wafer. In essence, multiple sets of tooling are required to produce different pair count wafers. It is also somewhat costly to use the same stamping and forming equipment for terminal assemblies of different pair count wafers as the stamping and forming members must be changed for each particular count wafer, thereby not only incurring labor, but also increasing manufacturing time.

Existing backplane cable connectors that utilize a wafer construction do not easily support wiring schemes that are more complex than connecting all pairs from one column to another column. "Lettered" wiring schemes, such as W, X and Y wiring schemes where the pairs track the configuration of the particular letter are difficult to construct. A need therefore exists fir a connector that utilizes signal pair components that reduce the cost of manufacturing.

The Present Disclosure is directed to an improved connector that utilizes individual signal pair elements which may be inserted into a variety of differently configured connector housings and which overcomes the aforementioned disadvantages.

SUMMARY OF THE PRESENT DISCLOSURE

In accordance with the principles of the Present Disclosure, signal pair elements are provided with an integrated structure of signal terminals and ground terminals or shields that permit a connector designer to modify only the connector housing of a backplane connector assembly to accept a variety of signal pair arrangements. This concept eliminates the need for multi-pair wafers and replaces it with a single-pair element, or "chicklet," concept in which the signal terminals and ground plane are integrated together in a single unit that is insertable and removable from a connector housing. For a new pair count connector assembly, the only structure that needs to be tooled is a front connector housing and its associated tooling, i.e., molds and inserts, should cost less than $25,000.00. This greatly reduces the cost of entry for new connector design programs, even for programs with smaller volumes as tooling for specific count wafers can approach and even exceeds $500,000.00.

If any single pair within a multi-pair wafer is bad (e.g., open, short, miswired, bad impedance or insertion loss) the entire wafer has to be discarded, with all of its associated signal terminals and ground planes, In doing so, a repairman must cut all of the wires associated with the bad wafer and terminate them to the replacement wafer, which increases the time and cost of repair. In the design of the Present Disclosure, only a single pair element needs to be replaced if it is bad and logically, only 2-3 wires will need to be terminated to a replacement signal pair element. This alone minimizes the amount of labor and materials that are lost to a defective single pair. Futhermore, because the smallest unit, or building block, of connectors of the Present Disclosure is a signal pair element, or chicklet, which integrates the signal pair and a ground plane together, it now is feasible to support complex wiring patterns in a connector housing in any W, X or Y fashion. In terms of system architecture, it means that pairs from one column on a line card can be split up to go to many other line cards.

In accordance with an embodiment as described in the following Present Disclosure, a signal pair element is defined by two elongated conductive signal terminals that extend longitudinally in a spaced-apart fashion. An insulative support frame is provided that supports the two signal terminals in their spaced-apart arrangement. The frame may have one or more openings that encompass portions of the terminals to control the characteristic impedance of the signal pair element at that location. The leading ends of the terminals include contact portions preferably formed as pins which engage corresponding contact portions of an opposing, mating connector. The terminals include tail portions at their opposite ends and wires of a cable are terminated to them, preferably by soldering, welding or the like.

A ground member, preferably in the form of a ground shield, is provided in association with each pair of signal terminals. The ground shield may have a general U-shaped configuration to define an elongated ground channel in which the signal pair terminals are supported. In this regard, the ground shield has a wide base that extend transversely to the longitudinal axes of the signal terminals and two spaced-apart sidewalls that are spaced transversely from the terminals and which define sides of the signal pair element. The frame is received within the interior of the ground shield and it serves to space the signal terminals from the ground shield base and sidewalls. Accordingly, the terminals are bounded on at least three of their four sides by a portion of the ground shield. The area where the cable wires are terminated to the signal terminals is filled with an insulative material, such as a hot melt, low density polyethylene, polypropylene or liquid crystal polymer, to enclose and protect the wire terminations and form an integrated assembly in which the signal terminals, ground shield and cable wires are formed as a single piece, which is insertable into and removable from a single opening in a connector housing.

The cross-sectional configuration of the signal pair elements is preferably rectangular, and square configurations can also be utilized so that a manufacturer need only make simple openings in the connector housing to receive the signal pair element. As such, the signal pair element introduces both a signal pair and an associated ground structure that maintains a desired spacing between the pair of signal terminals and between the signal terminals and ground shield. Thus, the in-pair spacing is easy to maintain and the out-pair spacing between nearby other signal pairs is likewise easy to maintain. The openings in the connector housing do not have to be separately made or formed in a complex manner, because the ground plane is already integrated into the signal pair structure itself such that one opening will accommodate one signal pair element.

As such, the signal pair elements of the Present Disclosure and connectors incorporating them distinguish themselves from known waferized connectors in that they utilize individual signal pair elements, or chicklets, rather than columns or rows of multi-pair wafers. Such known wafers populate their columns with two or more differential signal pairs and necessarily further include associated ground terminals or a ground plane, overmolded to maintain the spacing between the signal terminals and the ground structure. Often two wafer halves must be assembled and pressed together to form a completed wafer wherein where the ground structure of one wafer is partially shared by an adjacent wafer. As one can easily see, such a structure is complex and costly to tool.

In contrast, the individual signal pair elements of the Present Disclosure can be inserted into any suitable connector housing in either lettered arrangements for custom mating applications or in conventional rows and columns. The signal pair elements may be inserted either manually or by machine and the channel-like configuration of the ground shield provides a protective shell that protects the contact portions of the signal terminals during insertion into a connector housing. The integration of the ground shield with the terminal support frame means that it is not necessary to form ground elements in the connector housing arranged in a particular pattern to mate with ground elements of an opposing, mating connector.

The individual signal pair elements of the Present Disclosure may be ganged together in a row or a band by means of a metal commoning strap or bar that engages not only the ground shield of each signal pair element, but also the outer conductive wrap of the cable wires to interconnect multiple signal pair elements via their ground shields. An insulative resin may then be molded over portions of the support frame, terminals, cable wires, ground shield and commoning strap to form a single row of signal pair elements which can be easily inserted into a like number of openings in a connector housing.

These and other objects, features and advantages of the Present Disclosure will be clearly understood through a consideration of the following detailed description.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
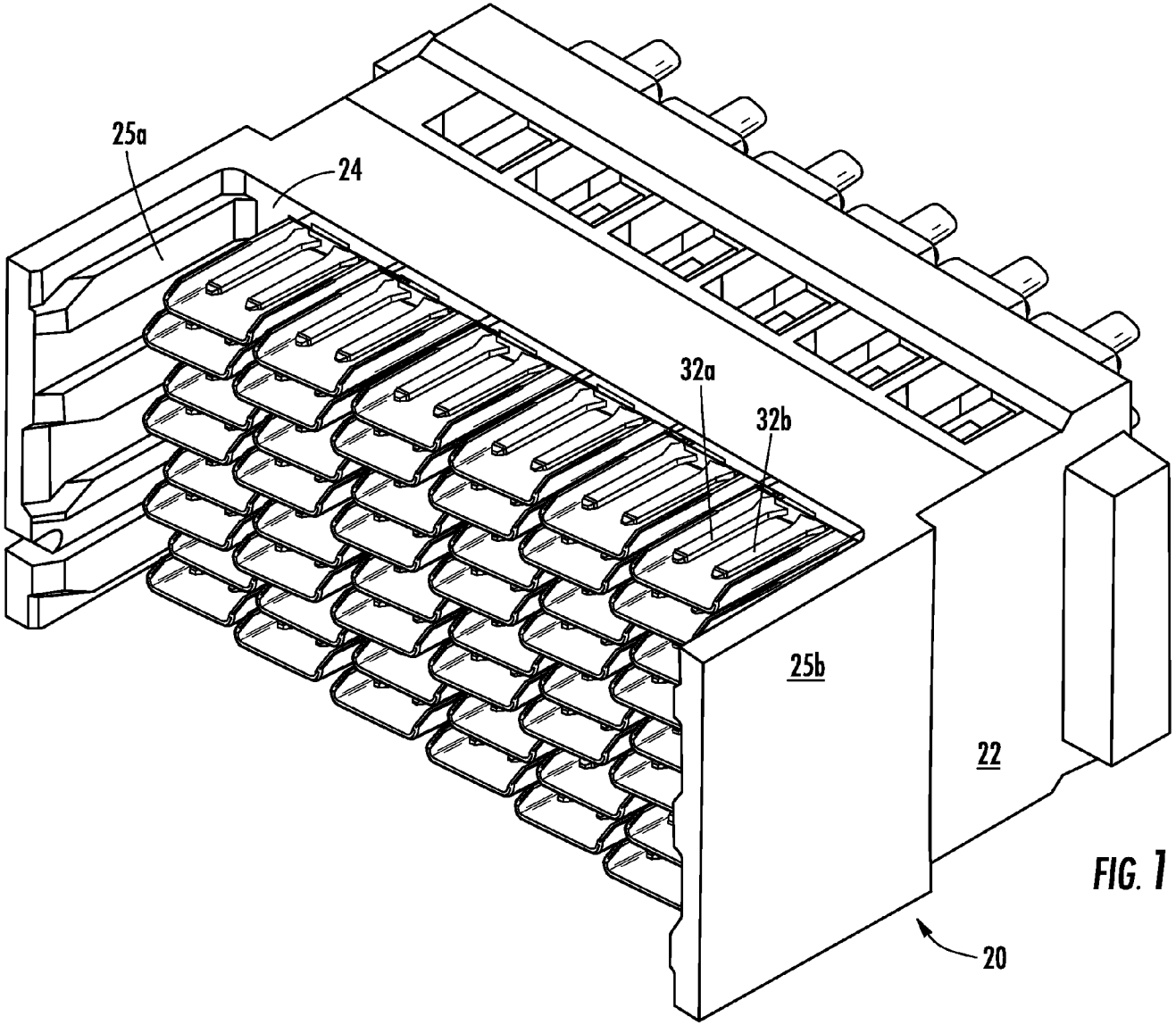
FIG. 1 is a perspective view of a backplane connector utilizing a plurality of individual signal pair elements, constructed in accordance with the principles of the Present Disclosure.
Figure 2:
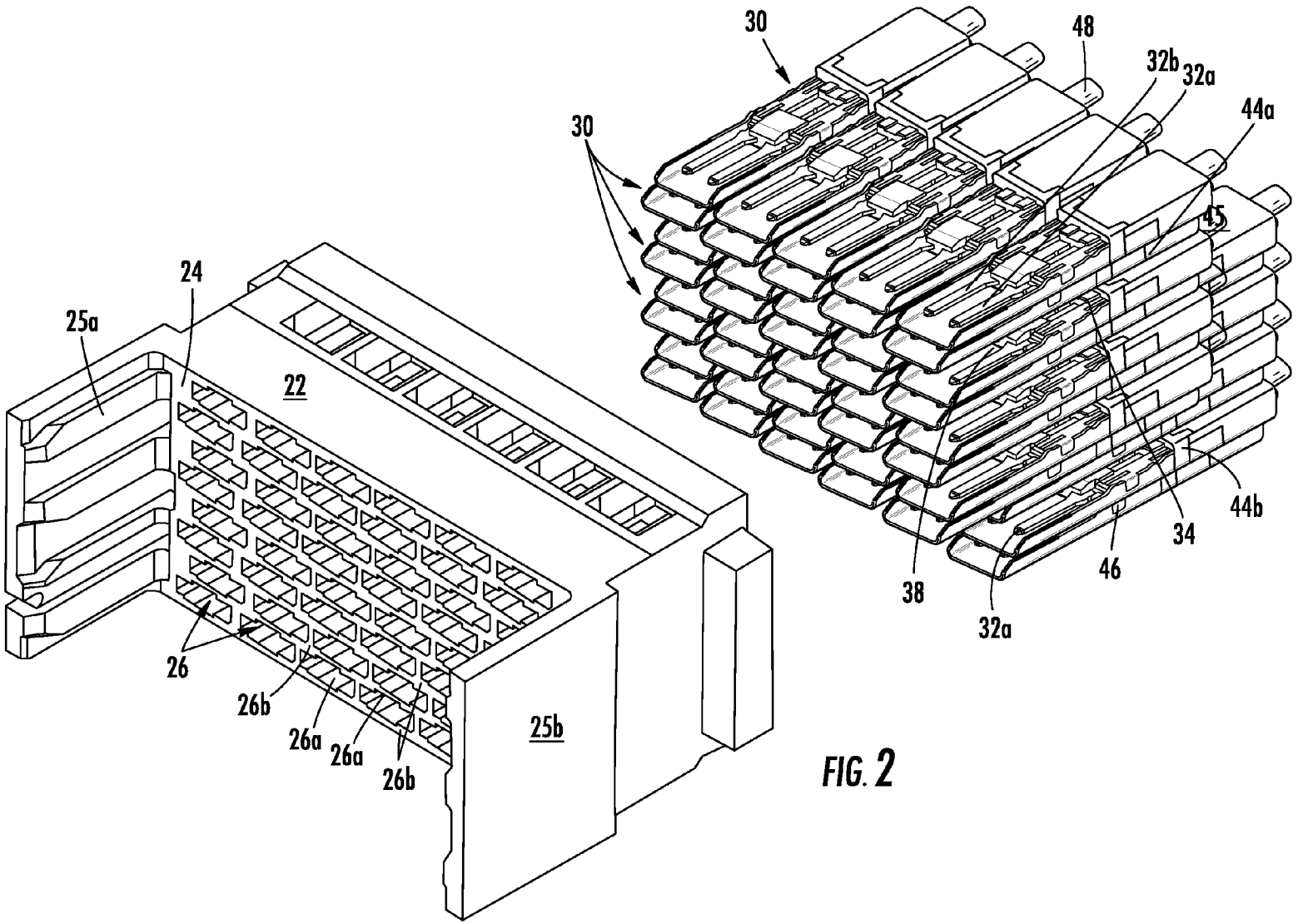
FIG. 2 is the same view as FIG. 1, but with all of the signal pair elements removed from the backplane connector frame.

FIG. 1 illustrates a backplane connector 20 that utilizes an insulative connector housing 22 with a flat base portion 24 and one or more sidewalls 25*a*, 2*b* that extend out from the base portion 24 to define a slot therebetween. The housing base portion 24, as illustrated best in FIG. 2 has a plurality of openings 26 formed therein in a desired arrangement. In FIG. 2, the arrangement is one of staggered openings. Conductive signal and ground elements extend through and out of these openings as will be explained in greater detail to follow.

In conventional waferized backplane connectors, a series of signal elements are supported by insulative frame portions. Ground elements are also usually incorporated wafers used in these style connectors and because they are supported by the insulative frame, the ground elements must necessarily take the form of flat, planer elements. It is difficult to insert mold complex configured ground elements with "complex" meaning the ground elements have portions that extend in at least two different directions and three distinct planes. This structural limitation can hamper a backplane connector designer on the wafer side of the connector assembly. This may lead to crosstalk issues in the connector.

Figure 4:
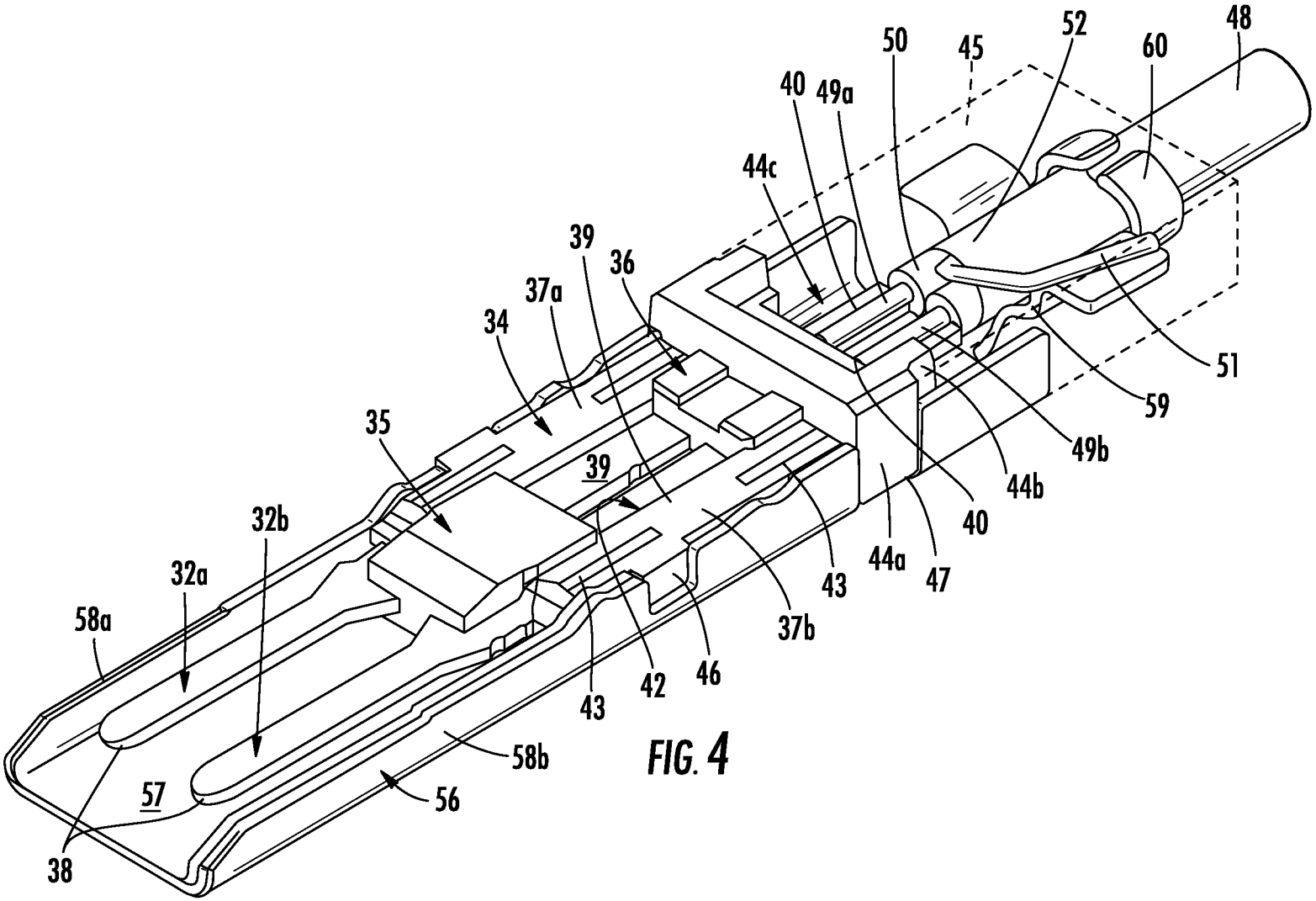
FIG. 4 is a perspective view of an individual signal pair element utilized in the backplane connector of FIG. 1, with the rear, overmolded portion shown in phantom for clarity.
Figure 4A:
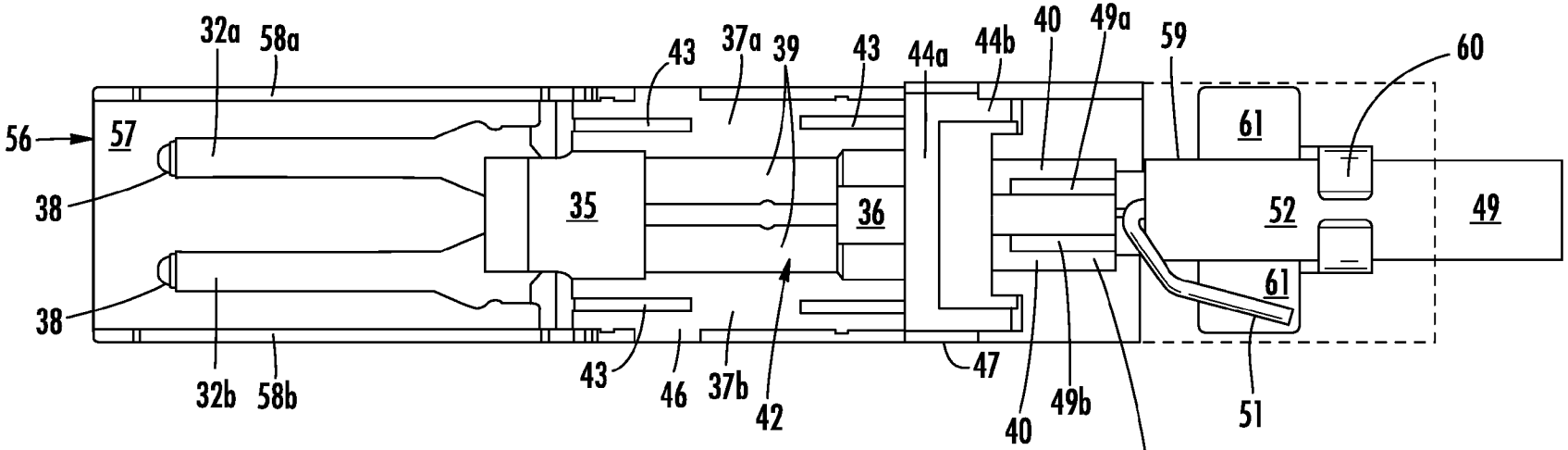
FIG. 4A is a top plan view of the signal pair assembly of FIG. 4.
Figure 4B:
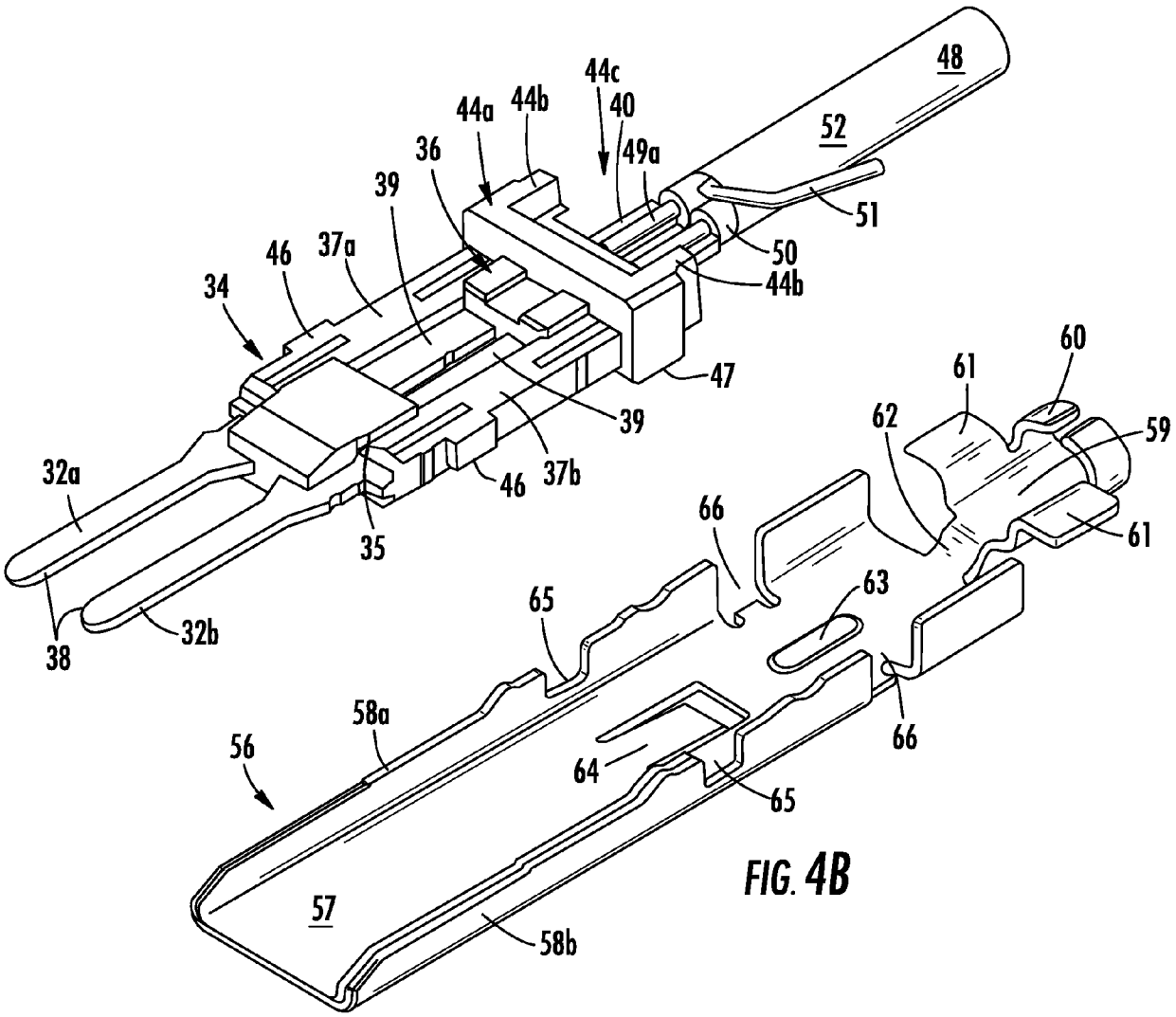
FIG. 4B is a partial exploded view of the signal pair element of FIG. 4, but with the signal pair assembly removed from its ground shield element.

Accordingly, the Present Disclosure is directed at new backplane connectors and signal pair elements used therein. As shown in FIG. 4, the Present Disclosure provides a plurality of individual signal pair elements, or chicklets, 30, which are insertable into the connector housing 22 such that the conductive elements thereof project through the connector housing openings 26 in alignment with an opposing mating connector (not shown). Each signal pair element 30 includes a pair of elongated, conductive signal terminals 32*a, b* that extend longitudinally of the element 30. The signal terminals 32*a, b* have respective, opposing contact portions 38 and tail portions 40 which are interconnected by intervening body portions 39.

Figure 3:
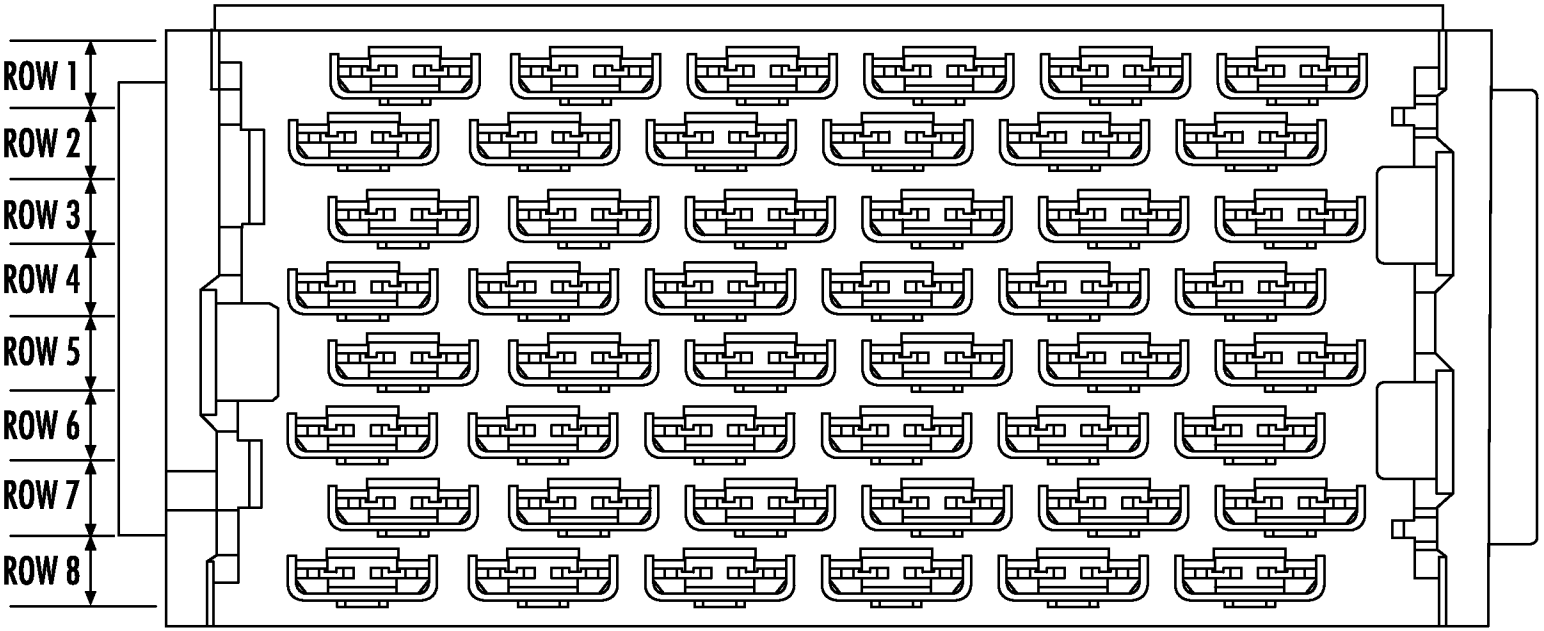
FIG. 3 is a bottom plan view of the backplane connector of FIG. 1, illustrating the arrangement of individual signal pair elements supported within the connector frame.

In practice, the terminals are spaced from the inside surface of the ground shield sidewalls a distance of L and the terminals of the pair are preferably spaced apart a distance equal to about or equal to 2L as a preferred spacing. The terminals are also preferably spaced above the ground shield a height of about 40% of the height from the inner surface of the ground shield base to the top edge, with "top" taking the orientation as shown in FIG. 3.

Figures 4C, 4G:
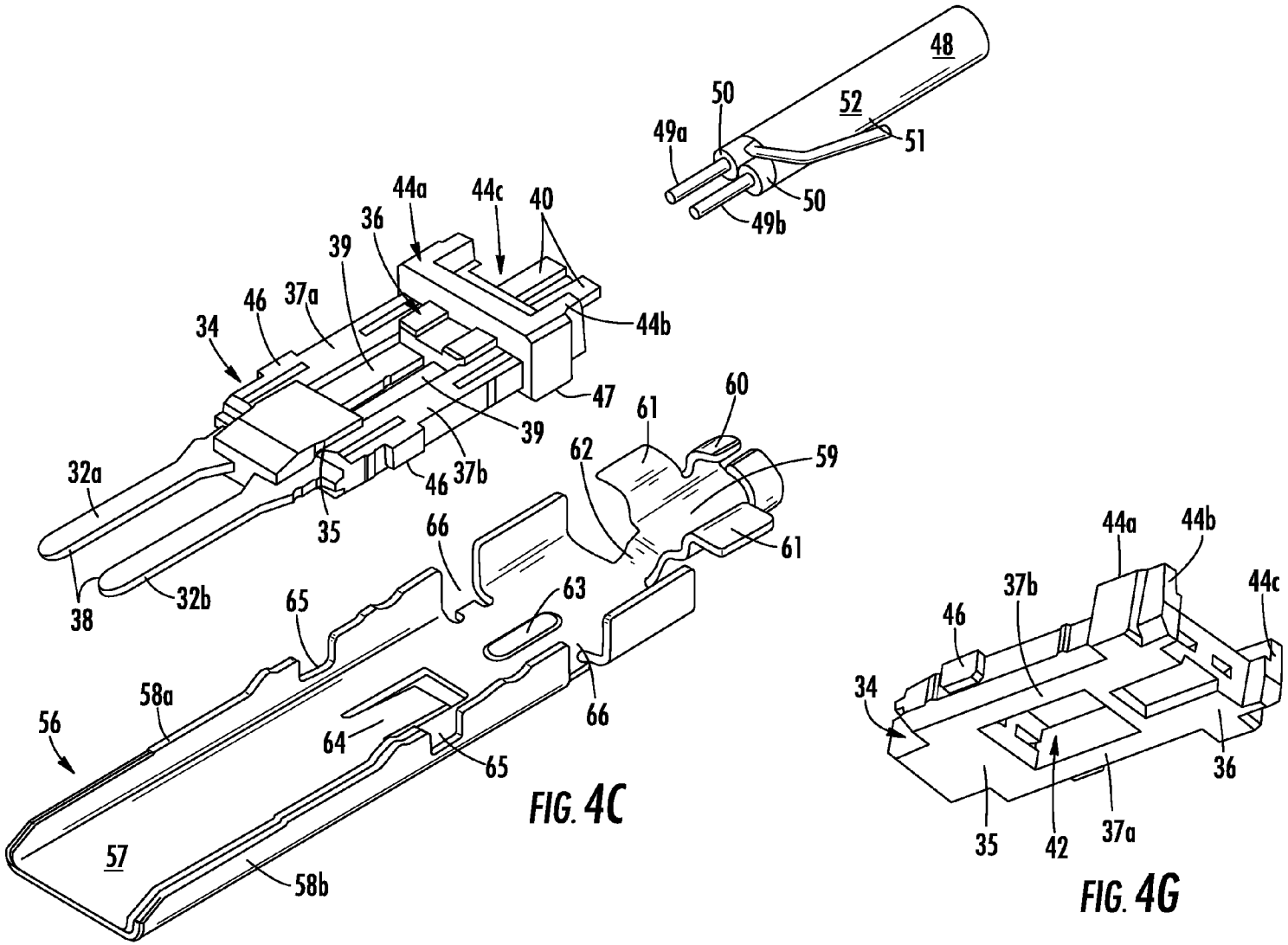
FIG. 4C is the same view as FIG. 4B, but with the signal pair cable wires removed from the signal pair assembly for clarity.
FIG. 4G is a perspective view, taken from the bottom, of the support frame with the terminals removed for clarity.
Figure 4D:
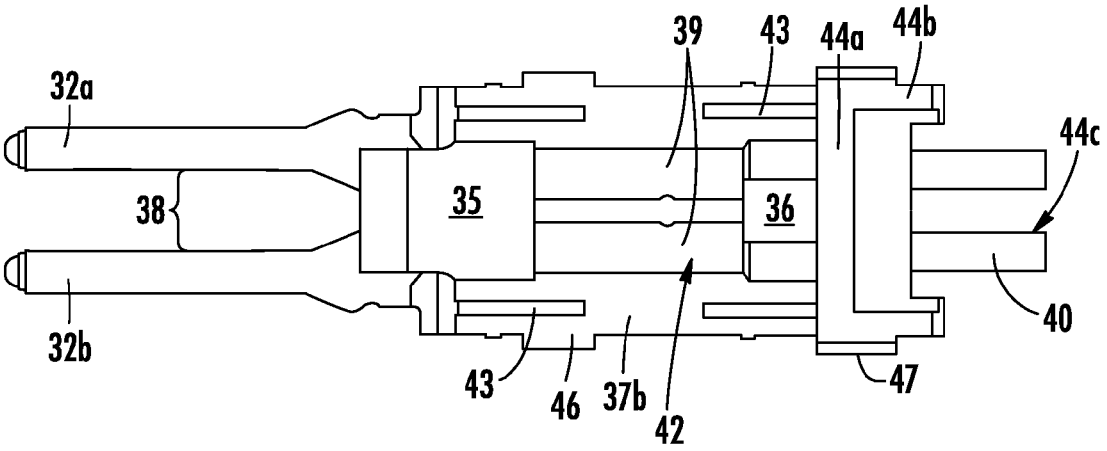
FIG. 4D is a top plan view of the two signal terminals supported by their insulative frame.

The terminals 32*a, b* are supported in an insulative frame 34 that includes a front mounting portion 35 and a rear mounting portion 36 that are spaced apart from each other in the longitudinal direction. These two mounting portions 35, 36 extend transversely with respect to the terminals 32*a, b* and are overmolded onto the terminals. The mounting portions 35, 36 include body portions that are disposed in the space between the terminal pair and may be joined, as illustrated in FIGS. 4C-D, to longitudinal portions that define, in effect, sidewalls 37*a, b* of the support frame 30. The two mounting portions 35, 36 are joined to the sidewalls 37*a, b* and cooperatively define an open window 42 that exposes portions of the terminal body portions 39 to air. The sidewalk 37*a, b* may include portions that serve as crush ribs 43 on their upper surfaces, which assist in holding the signal pair elements 30 in place within the connector housing 22. The bottom surface 41 of the support frame 34 is preferably flat as shown in FIG. 4G. The rear portion of the bottom surface 41 may include a recess 41*a* that receives the support frame button 63.

The support frame 34 is shown as further including an endwall 44*a* that extends transversely and a pair of shoulder portions 44*b* that extend longitudinally rearwardly from the endwall 44*a* to define a termination nest 44*c* in which the terminal tail portions 40 extend. This area is overmolded with an insulative material 45 which serves to fix the termination of the signal pair element 30 to the cable wires 48 as well as maintains the signal pair spacing and alignment. The signal pair conductive elements include the aforementioned signal terminals 32*a, b* and also a ground plane element that is shown in the Figures as an elongated ground shield 56. The ground shield 56 includes a base portion 75 which is generally flat and the shield includes a pair of upturned flanges that define sidewalls 58*a, b* that extend for almost the length of the ground shield 56. The general U-shape that the ground shield 56 has provides a ground plane for each terminal pair that extends along three of the four sides of the terminal pair. Such a structure promotes coupling by the terminals in three different directions. The front end of the ground shield 56 may take the form of a mating blade as shown that provides a flat surface for contacting an opposing ground element of a conventional mating connector.

The rear end of the ground shield 56 is provided with a cable nest 59 that receives and supports a wire cable 48 having two signal wires 49*a, b* that are surrounded by outer insulative coverings 50. A drain, or ground wire 51, is typically provided for each wire pair 49*a, b* and it extends lengthwise through the pair underneath an outer conductive wrap 52. A free end of the cable 48 is prepared as a termination end and has a length of the free end of each wire conductor 49*a, b* exposed and the cable drain wire 51 folded back upon the cable 48 over the cable outer conductive wrap 52. The cable nest 59 is spaced apart from the ground shield base 57 and offset by way of a tab 62 in the vertical direction from the ground shield base 57, as best illustrated in FIG. 4C. The nest 59 further includes unable clamp 60 that has two arm portions 60*a* that are folded over the cable 48 and crimped, or otherwise contacted to the cable outer wrap 52. A pair of stablizing wings 61 extend outwardly from the cable nest 59 and serve to provide reinforcement for the rear, overmolded portion 45 of the element. These wings 61 will provide reinforcement for the overmolded portion 45 of the signal pair element, but also provide a contact platform, or surface, on which the cable drain wire is positioned fur soldering. Importantly, the drain wires 51 are folded backwards along the cable outer conductive wrap 52 so that it will not extend anywhere near the exposed free ends of the signal wires 49*a*, 49*b*. In this structure, the drain wires 51 extend in a direction opposite the direction in which the cable signal wire free ends extend.

The endwall 44*a* and shoulders 44*b* form a horizontal, general U-shape in the horizontal direction that partially encloses the terminal tail portions 40 and they cooperatively form a foundation for the overmolded portion 45 to adhere to the support frame 34 while enclosing the termination area, the cable nest 59 and the free ends of the cable wires 48. The cable nest wings 61 are captured by this overmolded portion 45, and they at least partially reinforce the area to resist failure during the assembly process if stress is applied to the signal pair elements. This area, as shown in 4-A, also fills the area between the exposed wire conductors and their associated tail portions with a plastic-type material having a certain dielectric constant so that the impedance of the system in the termination area may be kept close or at a desired level.

Figure 4E:
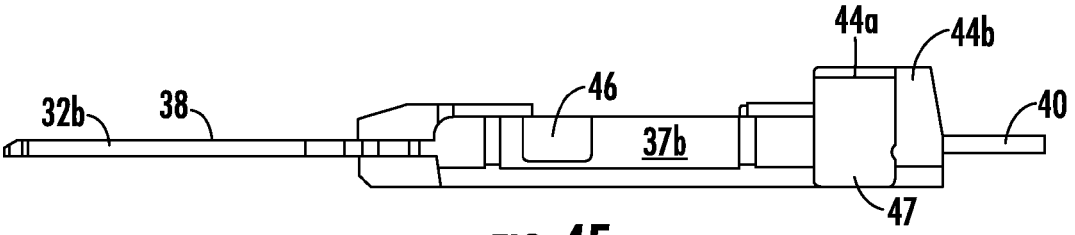
FIG. 4E is a side elevational view of the signal terminal assembly of FIG. 4D.
Figure 4F:
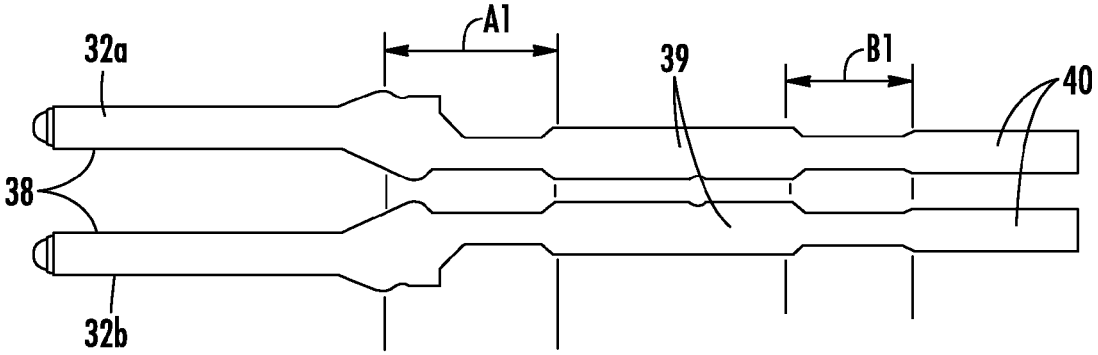
FIG. 4F is a top plane view of a pair of signal terminals used in the terminal assembly of FIG. 4D and removed from their support frame.
Figure 5:
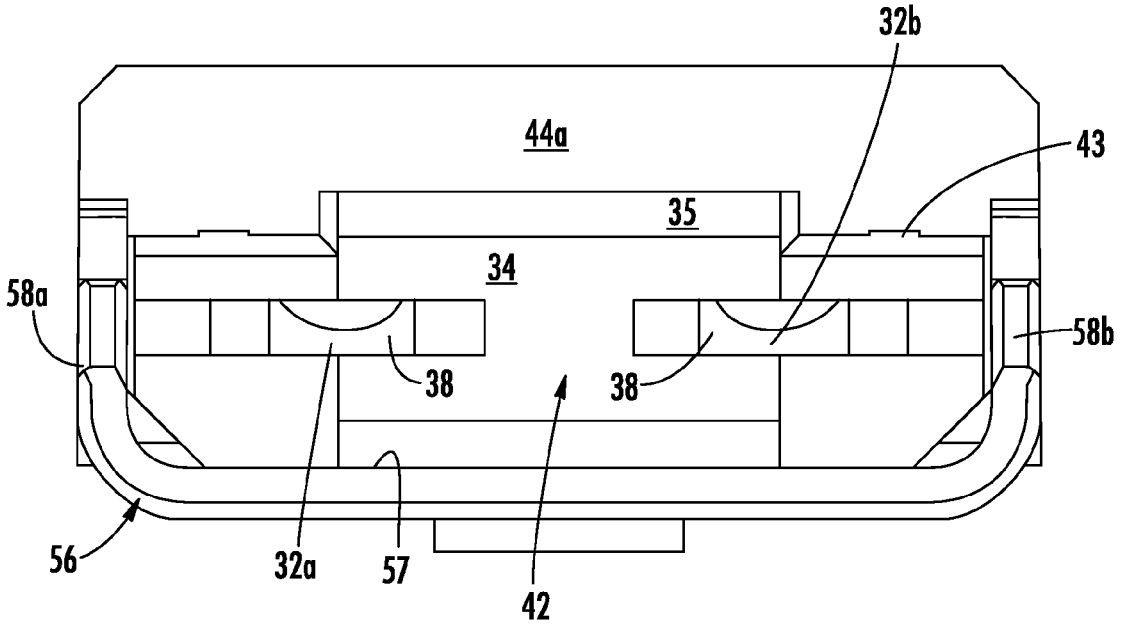
FIG. 5 is a front elevational view of a signal pair element.

Turning to FIGS. 4D-F, it will be noted that the signal terminals 32*a,* 32*b* have irregular shapes, but are substantially mirror images of each other. In particular, the width of the terminals 32*a, b* is narrowed in two areas, A1 and B1, and these areas occur where the front and rear portions 35, 36 of the support frame 34 engage the terminals 32*a, b*. In these areas, the spaces between the terminals 32*a, b* are filled in with the plastic or resin of the support frame 34 in order to maintain a desired amount of capacitive coupling between the signal terminals 32*a, b* as well as between the ground shield 56 and the two signal terminals 32*a, b*. The dielectric constant of the support frame material will be greater than the dielectric constant of air (1.0), so that in order to maintain a desired level of coupling between the signal pair, and the impedance profile through the signal pair element, it is preferred that the terminal widths in these areas are narrowed. The narrowing of the terminals in these two areas also creates edges along the sides of the terminals 32*a, b* that enhance the ability of the support frame material to fix the terminals in their desired spacing. Likewise, the width of the signal terminals 32*a, b* in the window 42 of the support frame 34 is larger than in other areas as the terminals in that area are separated only by air.

The support frame 34 preferably engages the ground shield 56 in a manner that retains it and its terminals 32*a, b* in a desired proper position. As shown one means for securing the support frame 34 to the ground shield 56 may include pairs of first and second stops, 46, 47 respectively that protrude outwardly from the support frame sidewalls 37*a, b*. These stops are preferably received within corresponding pairs of first and second slots 65, 66 so that the facing edges of the stops 46, 47 and the slots 65, 66 contact each other. The slots 65, 66 maybe configure as illustrated to include indentations or the like that engage protuberances on the stops 46, 47. An alternate means of engagement may include depressions formed on the support frame 34 and complementary-shaped indentations formed on the ground shield sidewalls 58*a, b.*

Figure 2A:
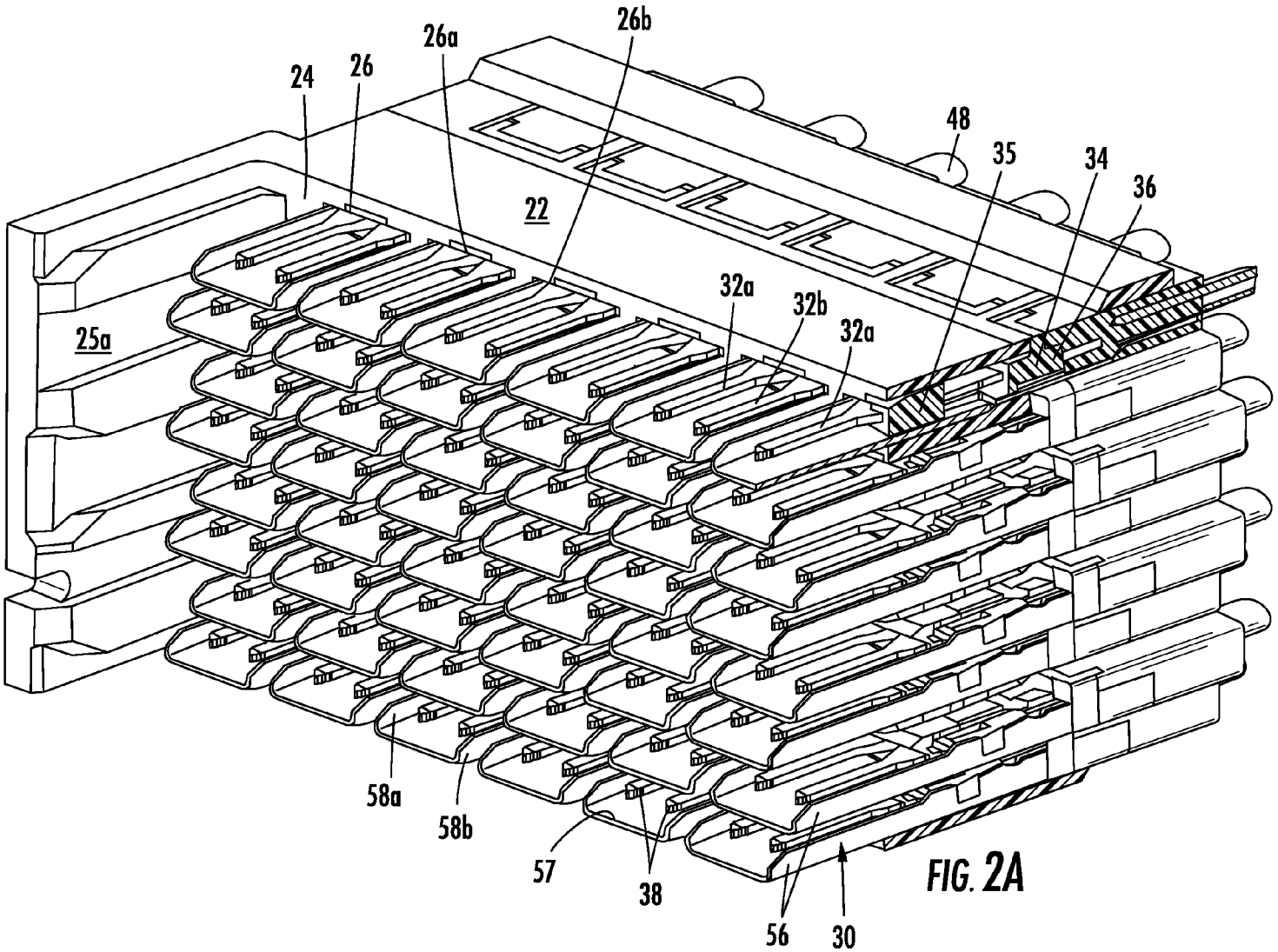
FIG. 2A is a sectional view taken along Line A-A of FIG. 1.
Figure 2B:
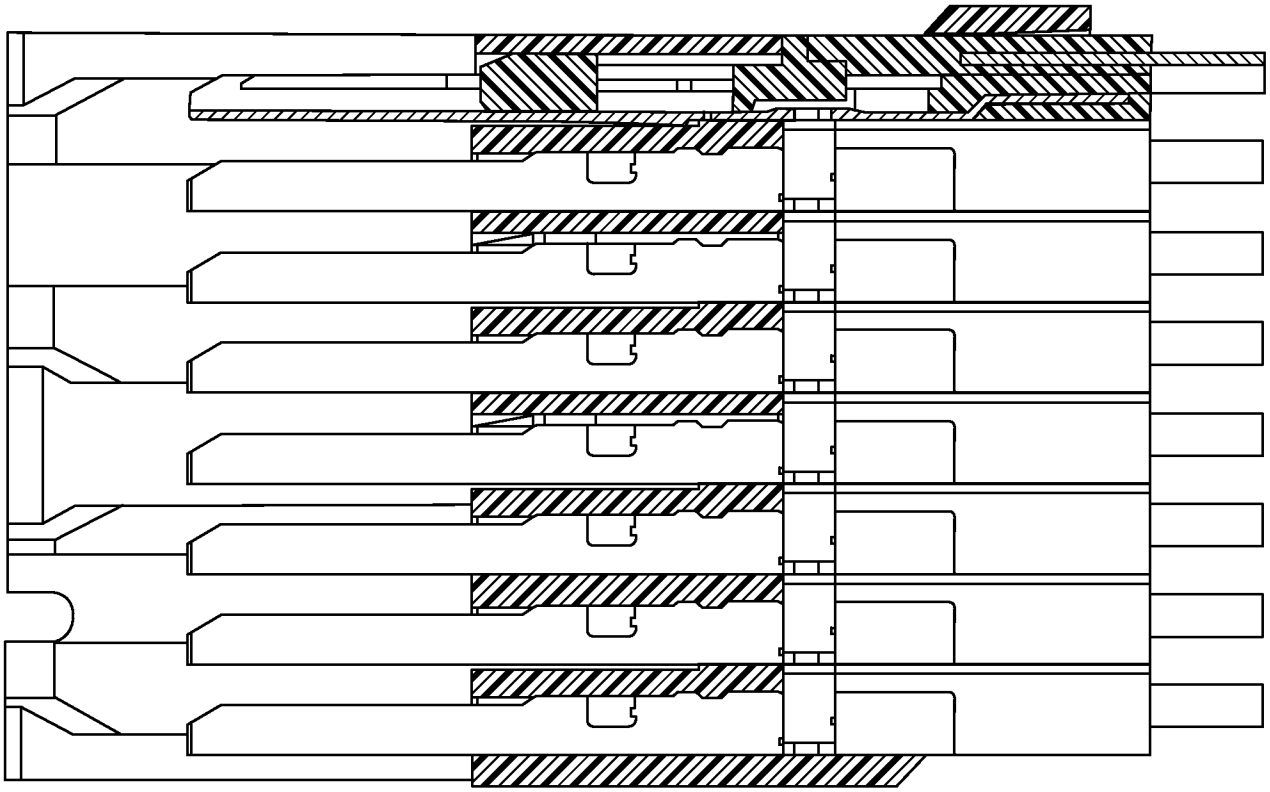
FIG. 2B is a side devotional view of the sectioned portion of FIG. 1.

The ground shield 56 may also include a raised member in the shape of an elongated button 63 that aligns the support frame with the ground shield. Elongated button 63 may be embossed, to aid in strength and rigidity of the ground shield at the location of the slots 66. In order to retain the signal pair element 30 in place within the connector housing 22, the ground shield 56 may include a catch portion, shown as a tongue or tab member 64 that is stamped in the ground shield base 57 and formed at an outward angle as shown best in FIGS. 2A-B to catch on a secondary shoulder 28 to resist forces that would tend to pull the signal pair elements 30 out of their connector housing openings 26. The support frame endwall 44*a* confronts and contacts a primary shoulder 27 formed in the connector housing 22 to limit the extent to which the signal pair element may be inserted into the housing opening 26. The openings 26, as shown, have a stepped configuration with central slots 26*a* and shoulders 26*b* so that interior surfaces of the shoulders 26*b* wilt engage the support frame sidewall crush ribs 43, and the interior surfaces of the slots 26*a* (shown at the bottom of the slots of FIG. 2) will engage the ground shield button 63.

It can be seen that each of the signal pair elements, or chicklets, 30 form an integrated signal pair with two terminals suitable for transmitting differential signals and which are supported within an associated ground shield that at least partially encloses the terminals on three different sides thereof, leaving only one side with selected surfaces of the terminals exposed. These exposed terminals will be spaced apart from the ground shield bases of the signal pair elements above (or below, depending on the orientation) so that coupling may occur with the ground shield of an adjacent signal pair element. This is best shown in FIG. 3, where, in the staggered arrangement shown, it can be seen the two terminals of each signal pair element in the odd-numbered rows are aligned vertically with each other. Likewise, the terminals of each signal pair element in the even-numbered rows are aligned together in the vertical direction. Furthermore, the right terminal of each pair in the even-number rows 2, 4, 6 and 8 is approximately centered with respect to adjacent ground shields of signal pair elements located above or below in the odd-numbered rows, and the left terminal of each signal pair in the odd-number rows 3, 5 and 7 is approximately centered with respect to adjacent ground shields of the signal pair elements above and below it. The signal pair elements in one row are offset from those in an adjacent row by about 4.7 min, or about 115 to about 120% of the width of a signal pair element.

This provides connectors utilizing the signal pair element with larger flexibility in design. These chicklets 30 are, in essence, individual building blocks of a backplane connector and may be arranged in a variety of different arrangements within a connector housing such as in lettered styles that display a C, H, O, U, X, Y or W configuration. Using such individual building block signal pair elements requires tooting costs only for simple the connector housings, which may only involve a single mold with different inserts, and not a complex one for complex wafers. For a new pair count in a connector design, only the connector housing needs to be tooled. If any signal pair in the connector is bad, only the bad signal pair element need be replaced, rather than discarding the entire wafer. The single signal pair element design therefore minimizes the labor and materials required to only that of a single pair element and not a multi-pair wafer, in which the conductive elements thereof need to be inserted into multiple openings in a connector housing.

Figure 6:
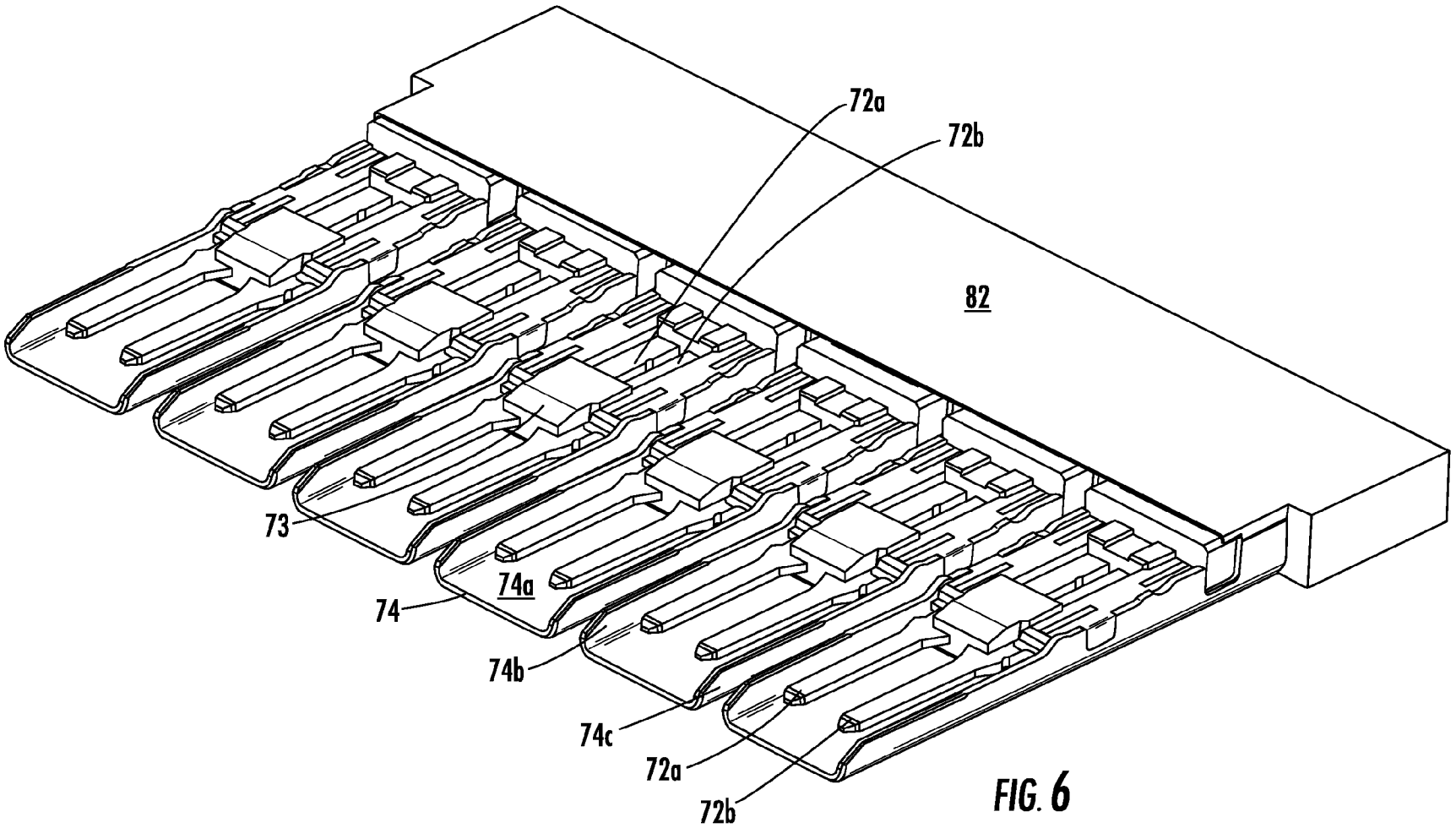
FIG. 6 is a perspective view of another embodiment, wherein a plurality of signal pair elements are integrated together into a row of single, signal pair elements.
Figure 6A:
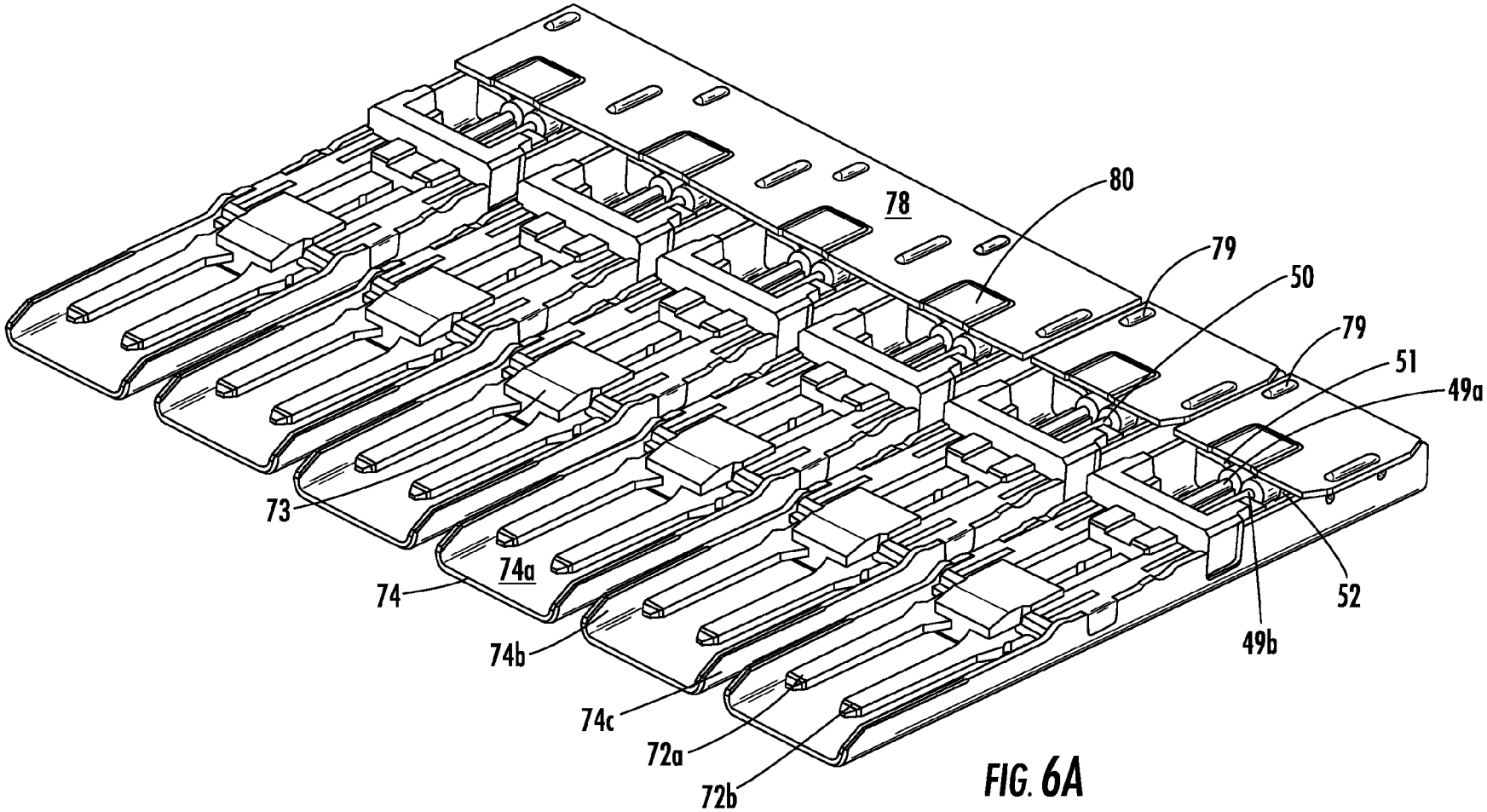
FIG. 6A is the same view as FIG. 6, but with the insulative overmold removed for clarity to illustrate how the commoning strap interconnects the individual signal pair elements.
Figure 6B:
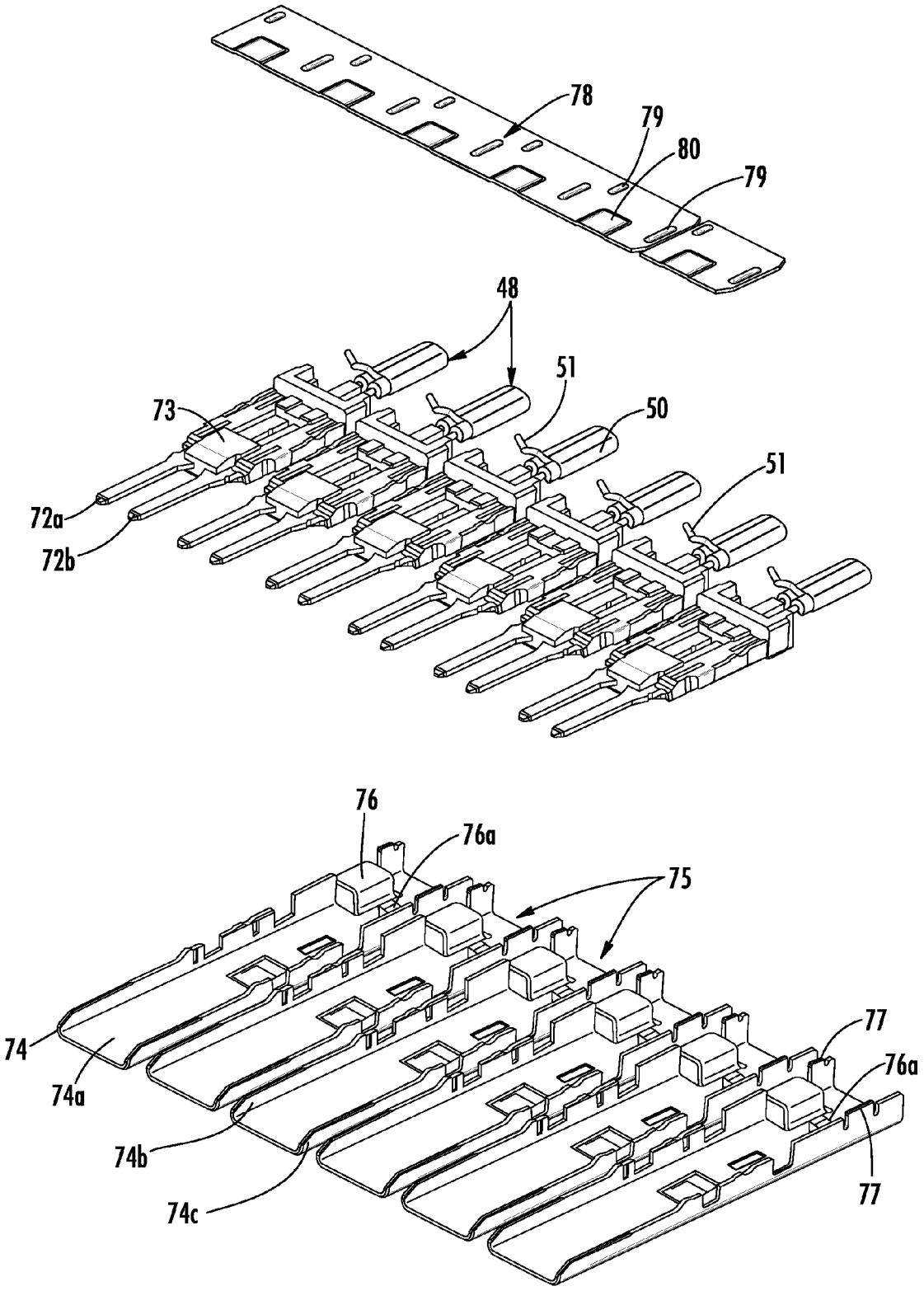
FIG. 6B is an exploded view of the ganged assembly of FIG. 6A.
Figure 7:
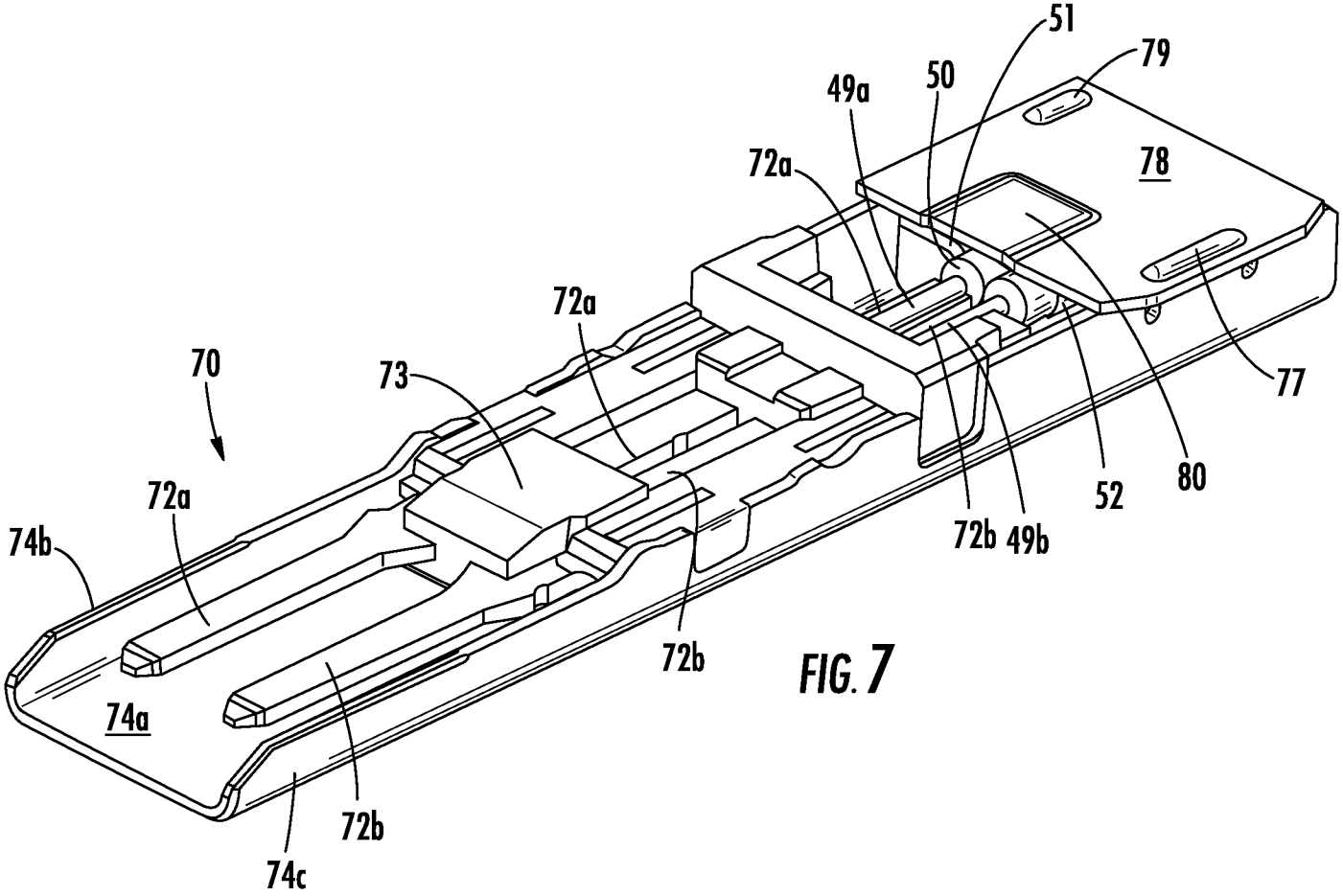
FIG. 7 is a perspective view of a single signal pair element used in the ganged assembly of FIG. 6.
Figure 7A:
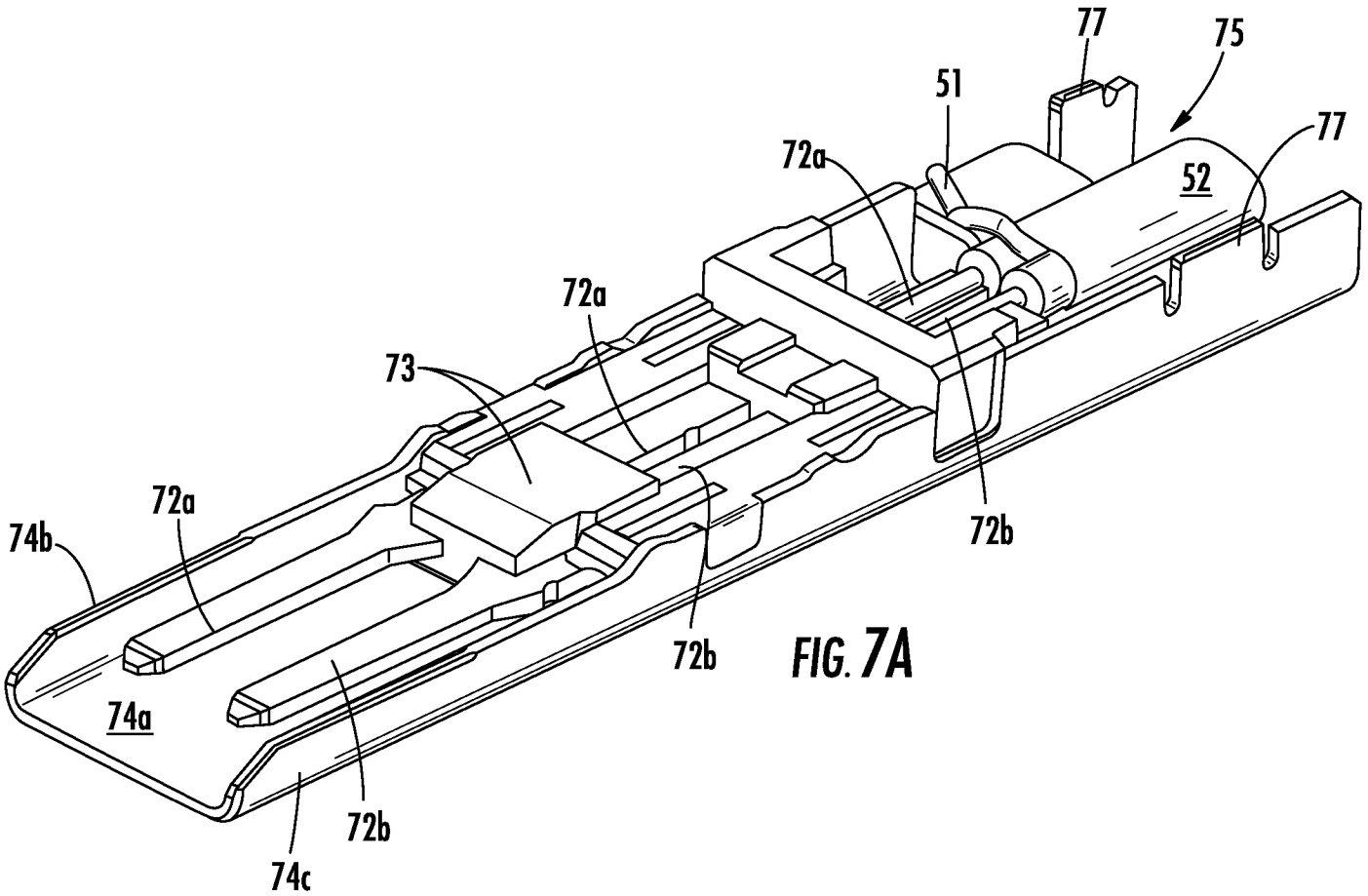
FIG. 7A is the same view as FIG. 7, but with the commoning strap removed for clarity.
Figure 7B:
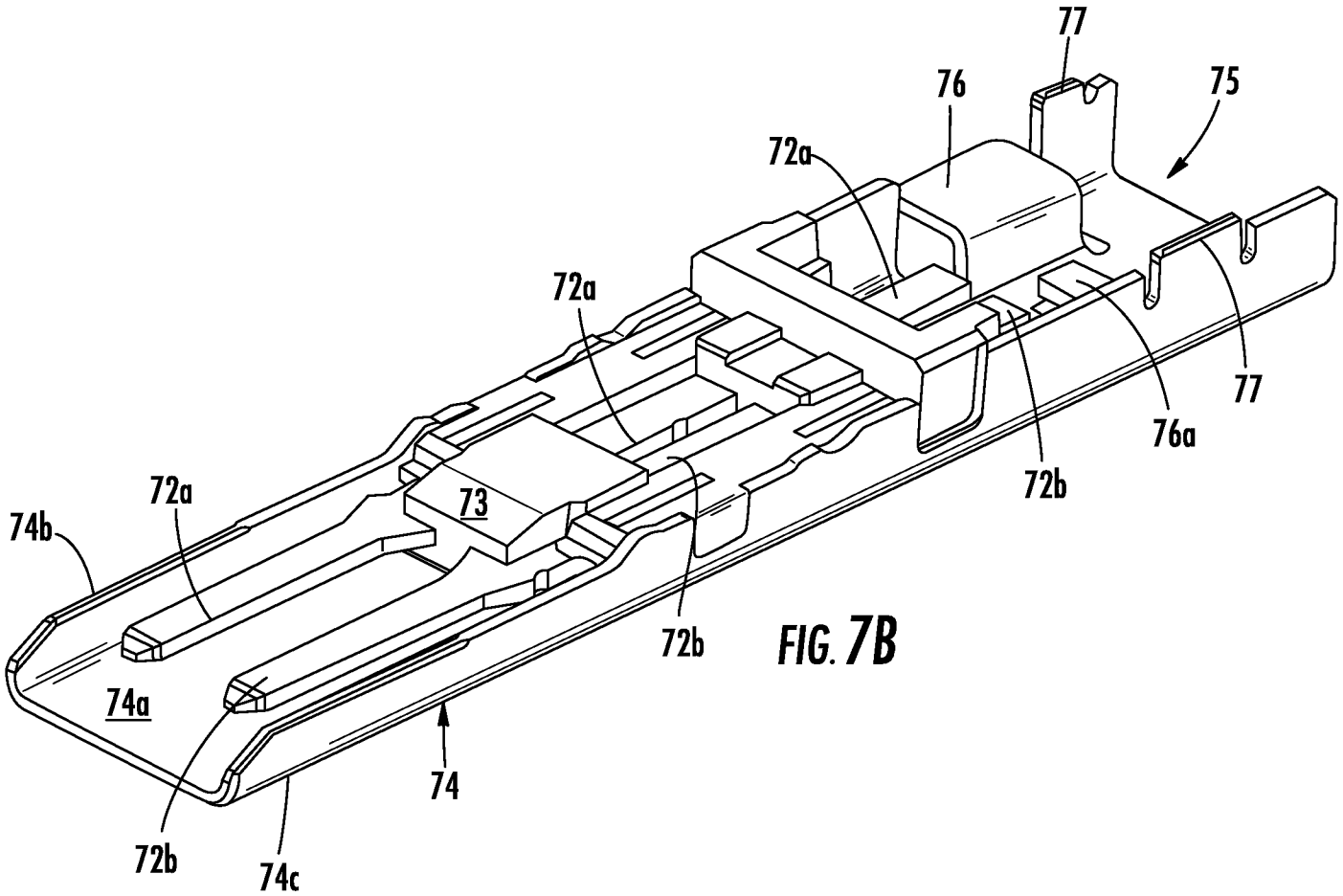
FIG. 7B is the same view as FIG. 7A, but with the cable wire pair removed to illustrate the structure of the wire nest.

FIGS. 6-7B illustrate an alternate embodiment of a signal pair element 70 according to the Present Disclosure, and one that is particularly suitable for use in ganged applications where a plurality of signal pair elements 70 are interconnected to form a linear array 71 of such elements 70. The arrays 70 may then be inserted as a group to speed up the connector assembly process, but each signal pair element, i.e., the terminal pair and ground shield, are still inserted into corresponding single openings 26 of a connector housing 22. It can be seen in FIG. 6 that each signal pair element 70 supports a pair of conductive terminals 72*a, b* and an insulative support frame 73. As with the prior embodiment, the support frame 73 and terminal pair 72*a, b* are partially encompassed by an associated ground shield 74 that has a general U-shaped configuration with a flat base 74*a* that is flanked by two sidewalls 74*b, c*. The ground shield base 74*a* and sidewalk 74*b, c* extend around and partially encompass the terminals 72*a, b* to present a ground plane on at least three sides of the terminal pair, providing coupling in three directions.

The rear end of the ground shield 74 includes a wire nest 75 that receives the free ends of a cable wire pair 49*a, b* therein; this nest 75 includes portions of the ground shield sidewalk 74*b, c* and an inner shoulder 76 that is stamped and formed from part of the ground shield 74. Preferably, this inner shoulder 76 contacts the outer wrap 52 of the wire pair 49*a, b* and urges it into contact with the opposing sidewall 74*c* of the ground shield 74. A second lower shoulder 76*a* may be provided as shown in FIG. 7B which provides a second point of contact between the wire outer wrap 52 and the ground shield 74 along the bottoms of the wire pair 49*a,*

*b*. The top surface 74*b* of the inner shoulder provides a surface to which the wire pair drain wire 51 may be connected.

A commoning member 78 is provided to interconnect multiple signal pair elements by way of their ground shields. The commoning member 78 extends transversely across the ground shield 74 and engages the ground shield sidewalk 74*b, c* by way of complementary shaped shield tabs 77 and commoning member slots 79. The commoning member 78 extends transversely with respect to the signal pair element 70 and may include, as illustrated, a raised bump or detent, 80 that accommodates the difference in heights between drain wire 51 and the cable pair outer wrap 53. The commoning member 78 may be a singular member, that is, extending across only a single signal pair element ground shield, or it may extend further transversely and commonly connect multiple signal pair elements by way of their associated ground shields in the fashion of a linear array. As such, the commoning member 78 of this embodiment 70 serves a similar purpose as the wire nest ground clamp 60 of the prior embodiment.

An insulative material 82 is molded over the terminal tail portions, the wire pair free ends, the ground shield 74 and the commoning member 78 to form a structure that interconnects the signal pair elements 70 together in a linear array 71 that holds individual signal pair elements 70 in a desired arrangement. Although shown as an entirely linear array, it will be understood that the signal pair elements of such array may be out of plane, as if they were interconnected in an alternating arrangement of peaks and valleys or if they were interconnected in a vertical direction. The integrated structure of the singular signal pair element that permits single insertion of such elements into single openings of a connector housing permits the interconnection or ganging of multiple elements together to form arrays of elements. Such arrays will cut down the time needed for insertion of singular elements while still maintaining the integrated structure of the signal pair element which permits insertion of a single signal pair element into a single opening of a connector housing.

The signal pair elements of the Present Disclosure not only provide an economic benefit to a connector designer due to their reduced cost, especially when repair and/or replacement is considered, but also in electrical performance. A connector design of the type illustrated in FIG. 3 was electrically modeled and compared against a model of a conventional waferized model. The modeling revealed that over the range of 2.5 to 15 GHz frequency the signal pair element concept of the Present Disclosure showed an improvement of between 4 and 10 dB as compared to the conventional waferized model and performed, for the most part better against it in the 15 to 25 GHz frequency range. This modeling showed that there was less energy coupled from the aggressor pair to the victim pair and that the majority of the energy at 25 GHz was below 17.5 GHz. Thus, the signal pair elements of the Present Disclosure also provide performance improvements.

While a preferred embodiment of the Present Disclosure is shown and described, it is envisioned that those skilled in the art may devise various modifications without departing from the spirit and scope of the foregoing Description and the appended Claims.

What is claimed is:

1. A signal pair element for insertion into a connector housing, the signal pair element comprising:

a pair of elongated, conductive terminals, each terminal extending longitudinally and spaced apart from each other, each terminal including respective contact portions and tail portions disposed at opposite ends thereof, the contact and tail portions being interconnected by body portions;

an insulative support frame supporting the terminals, the support frame including at least first and second portions, each portion extending tranversely with respect to the terminals and engaging the terminals to fix them in a spaced apart arrangement, the first and second support portions being spaced longitudinally apart from each other, the first and second portions supporting the terminals in the spaced-apart relationship; and an elongated ground shield, the elongated ground shield having a channel configuration and including a base flanked by two sidewalk, the support frame being disposed in the channel and extending transversely between the sidewalk, the support frame spacing the terminal pair above the base, the ground shield, the support frame and the terminal pair being held together as a single piece which can be inserted into a single, common opening of a connector housing.

2. The signal pair element of claim 1, wherein the support frame includes side portions that extend lengthwise alongside the terminal pair, and are interposed between the terminals and the sidewalls.

3. The signal pair element of claim 1, wherein the support frame includes an opening disposed between the first and second portions, exposing portions of the body portions to air.

4. The signal pair element of claim 1, further including a pair of wires respectively terminated to the tail portions, and wherein the ground shield includes a wire nest for receiving the wire pair and holding it in alignment with the support frame, the wire nest being formed as part of the ground shield, and the signal pair element further including a wire clamp tier contacting the wire pair against the ground shield.

5. The signal pair element of claim 4, further including a commoning member, the communing member contacting the sidewalls and extending transversely with respect to the ground shield over a termination area of the signal pair element, the commoning member serving as the wire clamp by contacting the wire pair.

6. The signal pair element of claim 5, wherein the commoning member extends transversely past at least one sidewall for connecting with ground shields of other signal pair elements to form a commoned array of signal pair elements, each signal pair element being insertable into a respective single opening of a connector housing.

7. The signal pair element of claim 1, wherein the support frame includes first and second stops that contact the ground shield to fix the support frame in position within the channel.

8. The signal pair element of claim 7, wherein the ground shield includes first and second notches disposed in the sidewalls, the notches engaging the support frame by respectively receiving the first and second stops.

9. The signal pair element of claim 1, wherein the support frame engages the sidewalls and extends transversely between the sidewalls, and the ground shield has a configuration such that it extends in two different directions and three different planes to partially encompass the terminal pair on three sides thereof.

10. A signal pair element for transmission of differential signals through a connector housing, the signal pair element comprising:

a pair of elongated, conductive terminals, each terminal including a contact portion and tail portion interconnected by a body portion;

an insulative support frame for supporting the terminals in a longitudinal, spaced apart arrangement, the support frame including at least first and second portions engaging the terminals to fix them in a spaced apart arrangement, the first and second support portions being spaced longitudinally apart from each other and extending transversely with respect to the terminals;

an elongated ground shield, the ground shield including a base flanked by two sidewalls which cooperatively define a Li-shaped channel, the support frame being disposed in the channel and spacing the terminal pair above the base and between the sidewalk, the support frame being further attached to the ground shield so that the signal pair element and the ground shield can be inserted into a single opening of a connector housing.

11. The signal pair element of claim 10, wherein the support frame includes side portions that extend longitudinally along the terminal pair and interposed between the body portions and the sidewalls.

12. The signal pair element of claim 11, wherein the first and second portions and the side portions are interconnected together and cooperatively define an opening in the is support frame that exposes portions of the terminals to air.

13. The differential signal pair element of claim 11, wherein the contact portions have a width, W, and are spaced apart from each other a distance less than or equal to 2W, and are spaced apart from the sidewalls a distance of W or less.

14. The differential signal pair element of claim 11, further including a pair of wires terminated to the tail portions and a wire ground clamp connected to the ground shield, the wire ground clamp contacting exterior surfaces of the pair of wires.

15. The signal pair element of claim 14, further including a rear insulative portion molded over portions of the wires, the tail portions and contacting portions of the support frame and ground shield.

16. The signal pair element of claim 14, wherein the wire ground clamp includes a commoning plate extending transversely with respect to the sidewalls and contacting the sidewalk and the wire pair.

17. The signal pair element of claim 16, wherein the commoning plate has a length whereby it can be connected to ground shields of other signal pair elements to form an array of individual signal pair elements interconnected together.

18. A high-speed connector, comprising:

insulative connector housing, the connector housing including a plurality of individual openings disposed therein in a predetermined pattern; and a plurality of individual signal pair elements, each signal pair element including:

a pair of conductive terminals, each terminal including contact and tail portions disposed at opposite ends thereof, the contact and tail portions being interconnected by a terminal body portion;

an insulative support frame, the support frame including at least first and second portions engaging the terminal pair to support them in a spaced-apart arrangement; and a ground shield, the ground shield including a base flanked by two sidewalls which cooperatively define a channel that receives the support frame and the terminal pair, the support frame, terminal and ground shield being interconnected together so that the terminal pair and ground shield is received in a single opening of the connector housing.

19. The connector of claim 18, further including pairs of wires terminated to the tail portions, and a conductive commoning member that interconnects some of the ground shields to form an array of signal pair elements so that individual signal pair elements may be inserted into respective single openings of the connector housing.

20. The connector of claim 19, wherein the commoning member extends transversely across the sidewalk of the arrayed signal pair elements and into contact with the wire pairs to urge them into contact with the ground shields.

21. The connector of claim 20, further including an insulative material molded over portions of the terminal pair, wires, ground shield and commoning member of each arrayed signal pair element.

22. The connector of claim 19, wherein each ground shield includes a wire nest that receives free ends of the wires, the wire nest including a press arm that contacts a drain wire of the wire pair.

23. The connector of claim 18, wherein the openings are arranged in a series of rows, alternating rows of openings being aligned with each other.

24. The connector of claim 18, wherein the openings are arranged in a series of spaced apart rows, the openings being aligned such that one terminal in one row is approximately aligned with a center of a signal pair element in an adjacent row.

* * * * *